United States Patent [19]

Tanaka et al.

[11] 4,051,341

[45] Sept. 27, 1977

[54] MICROWAVE OVEN DOOR SCREEN

[75] Inventors: Junzo Tanaka, Fujiidera; Toshio Kai, Yamatokoriyama, both of Japan

[73] Assignee: Matsushita Electric Industrial Co., Ltd., Osaka, Japan

[21] Appl. No.: 682,860

[22] Filed: May 3, 1976

[30] Foreign Application Priority Data

May 20, 1975 Japan ..... 50-60693

[51] Int. Cl.[2] ..... H05B 9/06

[52] U.S. Cl. ..... 219/10.55 D; 174/35 MS

[58] Field of Search ..... 219/10.55 D, 10.55 R, 219/10.55 F; 174/35 R, 35 MS

[56] References Cited

U.S. PATENT DOCUMENTS

| | | | |
|---|---|---|---|
| 2,920,174 | 1/1960 | Haagensen | 219/10.55 D |
| 2,958,754 | 11/1960 | Hahn | 219/10.55 D |
| 3,088,453 | 5/1963 | Grahn et al. | 219/10.55 D |
| 3,177,334 | 4/1965 | Kinkle | 219/10.55 D |
| 4,008,383 | 2/1977 | Tanaka et al. | 219/10.55 D |
| 4,010,343 | 3/1977 | Tanaka et al. | 219/10.55 D |

*Primary Examiner*—Arthur T. Grimley

*Attorney, Agent, or Firm*—Stevens, Davis, Miller & Mosher

[57] ABSTRACT

A structure of a microwave oven door screen which facilitates the observation of the inside of a heating cavity and enhances the safety against the electromagnetic wave leakage and durability. A door screen of this type generally comprises a pair of transparent plates and an electromagnetic wave shielding material interposed therebetween. The present door screen uses a punched metal plate as the electromagnetic shielding material made of aluminum having a thickness of 0.1 to 0.35 mm, an aperture diameter of 1.2 mm or less and a ratio of the aperture diameter to a center-to-center distance of an aperture of 0.67 to 0.85, these parameters being chosen such that an aperture rate of more than 40% is assured and the electromagnetic wave leakage through the door screen is effectively prevented (to meet the Regulations of U.S. Department of Health, Education, and Welfare) and a strain due to continuous mechanical treatment of the punched metal plate is minimized.

3 Claims, 7 Drawing Figures

MICROWAVE OVEN DOOR SCREEN

The present invention relates to a microwave oven, and more particularly to a structure of a microwave oven door screen.

A microwave oven is used to cook food by dielectric heating by making use of a high frequency electromagnetic wave in the order of 2450 MHz, and it includes a punched metal plate having a number of apertures stamped therein which punched metal plate is mounted on a door for closing a front opening to a heating cavity so that one can view cooked status of the food in the heating cavity.

Such a microwave door closure is described in U.S. Pat No. 3,731,035 issued to G. A. Jarvis et. al, on May 1, 1973. However, in this patent, a punched metal plate is not particularly designed to improve the viewability of the inside of the heating cavity and at the same time to minimize the leakage of electromagnetic wave energy. U.S. Pat. No. 3,304,401 issued to G. B. Long on Feb. 14, 1967 discloses a laminated see-through microwave door closure in which a perforated metal core has its inner surface covered by a transparent unperforate layer and the outer surfaces covered by a transparent unperforate layer of plastic, Pyrex glass or the like. Such a perforated metal core, however, does not appear to meet the standard for the leakage of electromagnetic energy set forth, for example, in the Regulation for the Administration Enforcement of the Radiation Control for Health and Safety Act of 1968 in the United States.

Furthermore, most of the conventional microwave door closures employ a punched metal plate having a thickness of not less than about 0.7 mm, and apertures of a diameter not less than 1.6 mm which are formed by a four to eight-step press treatment. As a result, an improvement in the aperture rate of the punched metal plate is necessarily limited resulting in a poor viewability of the inside of the heating cavity through the punched metal plate. For example, when an aluminum plate of 1.0 mm thickness is to be subjected to eight-step press treatment, the aperture rate has been limited to about 35%. If continuous treatment in which the metal plate is punched while it is moved sequentially, the aperture rate could be increased. However, since the material expands around the apertures, considerable strain is introduced to such an extent that the material can no longer be used as a viewing window.

The present invention is intended to overcomethe above difficulties.

It is a primary object of the present invention to provide a safe microwave oven having little electromagnetic wave leakage which uses a punched metal plate as a shielding body of a door screen, with the thickness thereof, aperture diameter and center-to-center distance of th apertures being appropriately chosen such that the strain in the punched metal plate after having been subjected to continuous stamp treatment is minimized.

It is another object of the present invention to prevent discharge between structural elements of the door by proper selection of material for the punched metal plate and properly surface treating the same, and to facilitate the observation of the inside of the heating cavity by blackening the screen to reduce the reflection of light.

It is a further object of the present invention to minimize the influence on an electric field distribution within the heating cavity and to enhance safety during the operation of the microwave oven by properly designing a transparent body of the door screen facing the heating cavity as well as the surface treatment thereof.

These and other objects, advantages and features of the present invention will become more apparent from the following detailed description of the preferred embodiments of the invention when taken in conjunction with the accompanying drawings.

Figure 1:
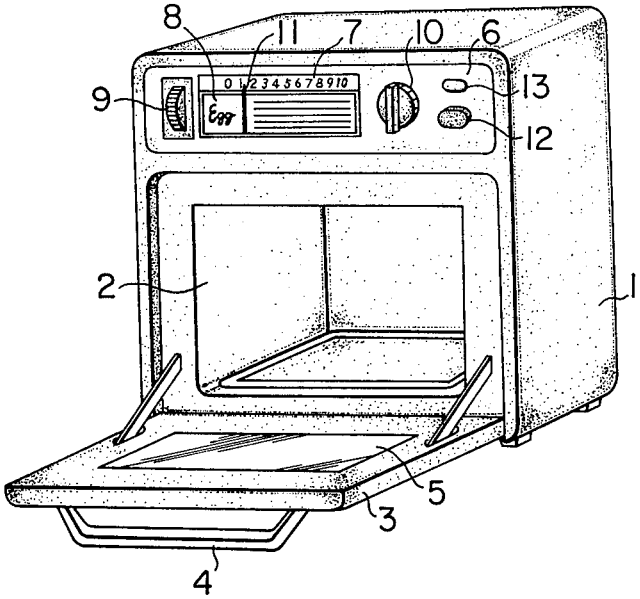
FIG. 1 shows an overall perspective view of a microwave oven with the door held open.
Figure 2:
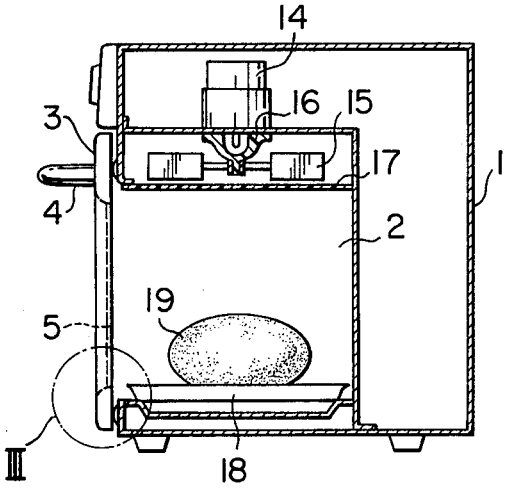
FIG. 2 shows a longitudinal sectional view thereof.

The microwave oven is usually used to cook food by dielectric heating by making use of a high frequency electromagnetic wave in the order of 2540 MHz. Referring to FIGS. 1 and 2, the microwave oven comprises an oven body 1 defining a heating cavity 2 therein and a door 3 mounted on the oven body 1 to close a front opening to the heating cavity 2. The door 3 is provided with a door handle 4 to aid the opening and closing manipulation of the door. There is formed a door screen 5 in the door 2 through which one can view the inside of the heating cavity 2. A control panel 6 is mounted on a front top of the oven body 1 and is provided with a time scale plate 7 for a timer and a dial plate 8 in juxtaposition. The dial plate 8 gives indications of heating time intervals for every selected variety of food to be cooked in respect of the quantity thereof. A control knob 9 is selectively set in dependence on the variety of food to be cooked. Thereafter, a timer knob 10 is turned to set a timer indicator needle 11 to a position on the dial 8 indicating the quantity of the selected variety of food. Then, the timer (not shown) generates an optimum cooking duration for the selected variety of food. Reference numeral 12 designates a cooking button for triggering the cooking operation. Numeral 13 denotes a cooking lamp which is turned on while the high frequency electromagnetic wave is being generated.

A magnetron 14 for emitting high frequency energy into the heating cavity is mounted on the oven body 1 over the heating cavity 2. A stirrer vane 15 rotatably mounted on a supporting shaft 16 is adapted to be rotated by wind used to cool the magnetron, thereby to stir the high frequency field in the heating cavity 2. A partition board 17 serves to isolate the stirrer vane 15 from the cooking cavity and a tray 18 for receiving food 19 to be cooked.

Figure 3:
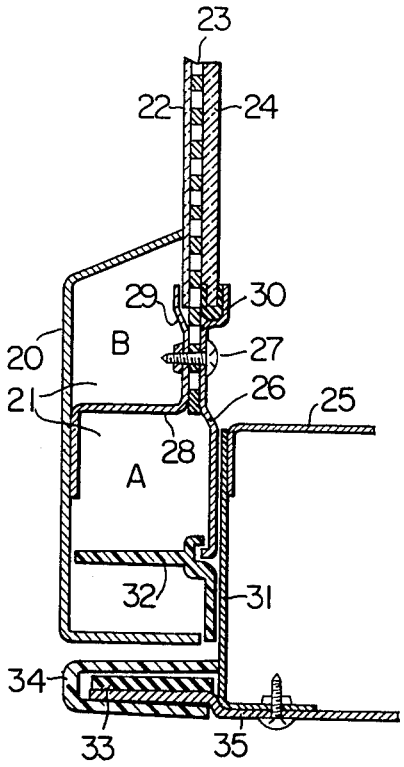
FIG. 3 is a fragmentary enlarged view of a portion encircled by III in FIG. 2.

Referring now to FIG. 3, the door body 20 has a channel 21 of U-shape in section along a periphery thereof, and it is formed with a door screen substantially at the center thereof. The door screen comprises a synthetic resin plate 22 such as polycarbonate plate, a punched metal plate 23 serving as an electromagnetic wave shielding body, and a strengthened glass plate 24. Welded to the door body 20 is a frame 28 to which fixed by a bolt 27 is a metal plate 26 which electrically couples the punched metal plate 23, the heating cavity body 25 and the door body 20. The frame 28 has a shoulder 29 at inner periphery thereof, which shoulder supports the synthetic resin plate 22. The punched metal plate 23 and the strengthened glass 24 having a packing 30 around the periphery thereof to prevent penetration of water vapor are carried by the metal plate 26 which is fixed by the bolt 27 to the frame 28. In this manner the door screen is mounted to the door. The metal plate 26 is made of an aluminum material having an insulation coating thereon such as a hard alumilite (anodized aluminum).

The metal plate 26 is also capacitance coupled to the front plate 31 of the heating cavity, and defines together with the door body 20 and the frame 28 spaces A and B to form a choke structure. Thus, a choke cavity defined by the space A prevents the electromagnetic wave leakage from the periphery of the door while a choke cavity defined by the space B prevents the electromagnetic wave leakage from a gap between the punched metal plate 23 and the frame 28. In FIG. 3, reference numeral 32 designates a choke cover of resin which covers an opening of the choke cavity and prevents flakes of food from entering the choke cavity. Reference numeral 33 designates a ferrite rubber member disposed to face the periphery of the door, 34 a protection cover for the ferrite rubber member 33, and 35 a bottom plate of the microwave oven body.

Figure 4:
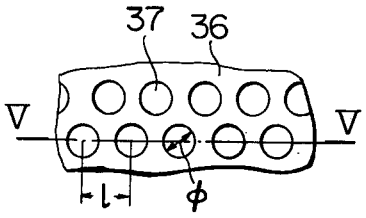
FIG. 4 is a plan view of a major portion illustrating the leakage of electromagnetic wave from a shield body.

Referring now to FIG. 4, the electromagnetic leakage from the punched metal plate 23 is diagrammatically illustrated.

In FIG. 4, 36 denotes a metal portion, and 37 denotes circular apertures formed by punching.

Figure 5:
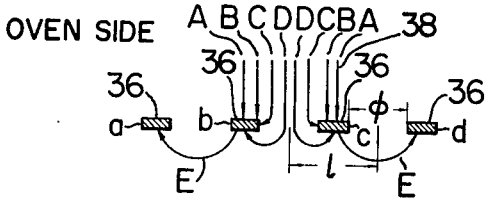
FIG. 5 is a sectional view taken along line V — V in FIG. 4.

FIG. 5, four metal strips *a, b, c* and *d* are shown in section, with high frequency electromagnetic waves leaking from the gap between the sections *b* and *c.* On the oven side, there occur electric lines of force 38 due to the high frequency electric power for heating the object to be heated. The electric lines of force 38 naturally penetrate the metal at right angle to the surface thereof. Accordingly, the electric lines of force A and B penetrate the metal sections 36 perpendicularly to the main surfaces thereof while the electric lines of force coming from the gap between the sections *b* and *c,* such as the electric lines of force C penetrate the metal sections from the sides thereof. The electric lines of force such as D leave of the heating cavity and then penetrate the metal sections from the outer or opposite surfaces thereof. The electric lines of force which leave the heating cavity induce additional electric lines of force E, which cause the electromagnetic wave leakage.

While only one aperture was considered in the above explanation, actually there are a number of such apertures. It has not been possible to determine the extent of the electromagnetic wave leakage for a particular aperture diameter $\Phi$ and a particular center-to-center distance $l$ of the apertures depending on the interaction of a number of apertures, boundary conditions of the viewing window and the door body, and nonuniformity of the electric lines of force in the heating cavity. This posed difficulty in designing the oven.

Figure 6:
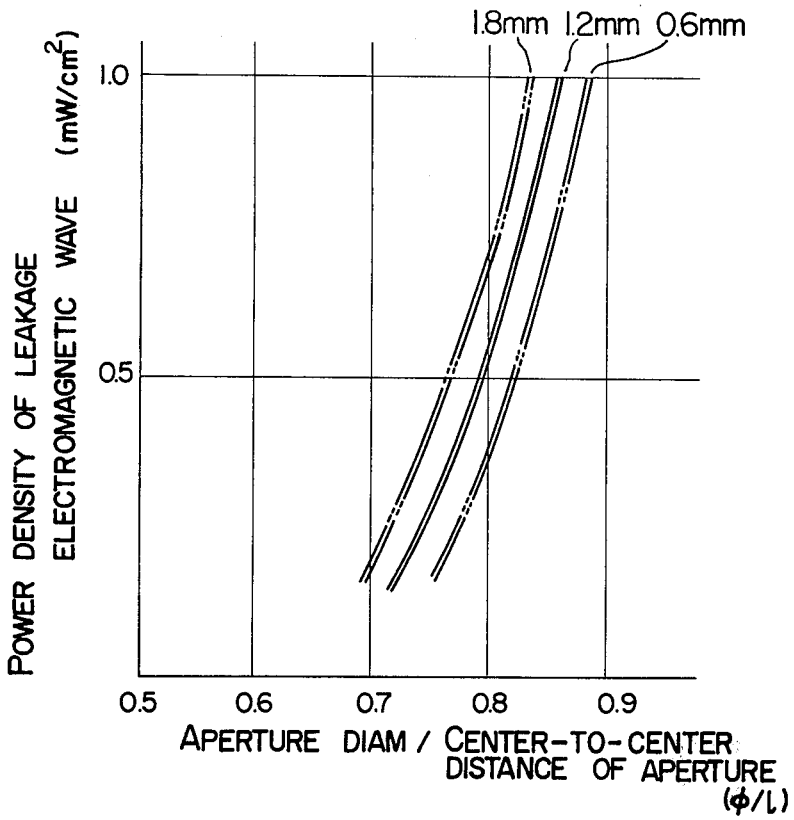
FIG. 6 is a graph showing the relation between a ratio of an aperture diameter to a center-to-center distance of apertures and a power density of electromagnetic wave leakage with the aperture diameter being 0.6 to 1.8 mm.

To solve the above problem, FIG. 6 shows the measurement of the electromagnetic wave leakage for various values of the ration $\Phi/l$ where $\Phi$ is the aperture diameter in FIGS. 4 and 5 and $l$ is the center-to-center distance of the apertures, with the plate thickness being 0.2 mm and the aperture diameters being 0.6 mm, 1.2 mm and 1.8 mm, in a microwave oven having a nominal output of 600 W. Taking the results of FIG. 6 as well as the feasibility of handling of the punched metal plate and the aperture rate into consideration, it has been determined that a punched metal plate having a thickness of 0.10 to 0.35 mm, an aperture diameter of not larger than 1.2 mm and a ratio of the aperture diameter to the center-to-center distance of the apertures of 0.67 to 0.85 was preferable. The data shown in FIG. 6 were measured under no load condition where only a glass tray was in the cavity.

The reason for selecting the plate thickness of 0.10 to 0.35 mm is as follows; when the plate thickness is less than 0.10 mm, tensile strength is weak and cracks occur during punching treatment, and if the plate thickness exceeds 0.35 mm, a person feels no problem when he views the cavity from the front but when he views obliquely, the apparent aperture rate decreases because of the thickness of the plate. For the punched metal plate shown in FIG. 4, the relation between the aperture diameter $\Phi$, the center-to-center distance $l$ of the apertures and the aperture rate $\phi_1$ is given by:

$$\phi_1 = \frac{\pi}{2\sqrt{3}}\left(\frac{\Phi}{l}\right)^2$$

Figure 7:
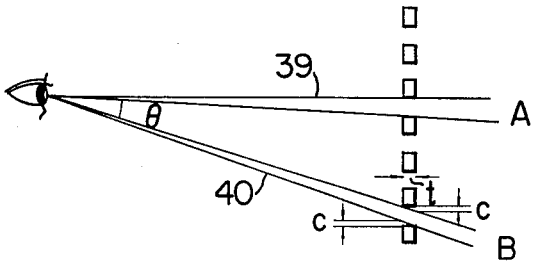
FIG. 7 illustrates an apparent aperture rate.

The above relation is applicable only when viewed from the front of the punched plate. That is, it represents the aperture rate for A 39 in FIG. 7. When viewed obliquely such as shown by B 40 in FIG. 7, the effective aperture is reduced by the amount of $2C = 2t \times \tan\theta$. Thus, if the plate thickness exceeds 0.35 mm, the apparent aperture rate is substantially reduced such that there is no advantage of using a separate punched metal plate.

A further reason is that when the plate thickness exceeds 0.35 mm, the material extends around the apertures when it is subjected to continuous punching process so that the center portion of the door screen is raised or expanded which results in an unsightly appearance.

The reason for selecting the ratio of the aperture diameter and the center-to-center distance between the apertures to 0.65 to 0.85 is due to the aperture rate and the power density of leakage electromagnetic wave. In order to attain an aperture rate higher than that obtainable by prior art press treatment to take advantage of using a separately punched plate, the aperture rate must be haigher than 40%. From the above equation for the aperture rate, it is seen that the aperture rate is higher than 40% when $\Phi/l$ is selected to be larger than 0.67. The requirement of $\Phi/l < 0.85$ is determined to limit the power density of the leakage electromagnetic wave below 1 mW/cm² in accordance with the relation of FIG. 6. In addition to the above requirement, if the aperture diameter is selected to be not larger than 1.2 mm, the power density of the leakage electromagnetic wave under no load condition never exceeds 1 mW/cm².

The IEC (International Electronics Committee) standard, which is supposed to be enforced in the near future, prescribes that the power density of the leakage electromagnetic wave under 275 cc water load positioned at the center of the heating cavity is not larger than 1 mW/cm². Furthermore, the Regulations for the Administration Enforcement of the Radiation Control for Health and Safety Act of 1968 in the United States also limits the power density of the microwave radiation emitted by a microwave oven to 1 mW/cm². In the present invention, however, it is designed that the power density under no load condition is not larger than 1 mW/cm² because in actual cooking application a small amount of food such as a piece of bread or an egg is frequently cooked in the oven and hence the leakage electromagnetic wave might amount to several mW/cm² if the oven is designed based on the water load condition. Furthermore, manufacturing tolerances have also been taken into consideration.

Another reason for limiting the aperture diameter to not larger than 1.2 mm is that, in addition to the requirement for the leakage of electromagnetic waves, if the aperture diameter exceeds 1.2 mm the areas between the apertures are so enlarged that the panel presents an unsightly appearance.

The material of the punched metal plate 23 and treatment thereof are now explained. As stated above, strain occurs when the punched metal plate is formed by continuous treatment. In order to minimize the strain, it is most preferable to use aluminum material having low expansion and low hardness. Such material can minimize the strain and the strain included can be corrected by a pair of transparent plates during assembling of the door.

The door body 20 and the frame 28 are made of iron plates on which resins are coated. The punched metal plate 23 is sandwiched between the resin coated frame 28 and the almilite treated aluminum plate 26.

It has been found that, if the punched metal plate 23 is made of a conductive material without surface treatment, the punched metal plate 23 penetrates into the coating by tightening pressure of the bolt 27 as the coating of the frame 28 becomes soft during extended operation of the microwave oven, causing imperfect contact between the iron plate of the frame 28 and the punched metal plate 23. This induces are discharge between the punched metal plate 23 and the frame 28 and the resulting heat causes these members to be deformed such that the leakage electromagnetic wave increases. The punched metal plate 23 is, therefore, made of aluminum, on which an oxidized coating of less than 15 microns is formed to overcome the above difficulty. At the same time it is blackened to reduce light reflection therefrom in order to facilitate viewing the inside of the heating cavity. When the oxidized coating exceeds 15 microns, the aluminum base material is attached or eroded and becomes brittle and the electrical resistance of the surface becomes so high that the safety is lost.

The strengthened or tempered glass 24 used is preferably a chemically strengthened glass which may be formed by ion exchange process for the following reasons.

1. When a thermally strengthened or tempered glass is used, the effect of strengthening can be appreciably observed only when the plate thickness exceeds about 3 mm, and no appreciable effect of strengthening is observed under less than 3 mm. Therefore, it is not permissible to use glass of less than 3 mm thickness. On the contrary, since chemically strengthened glass is manufactured in a quite different process, sufficient strengthening effect is attainable for the plate thickness of less than 3 mm. Furthermore, the chemically strengthening glass has considerably higher internal stress per unit area than the thermally strengthened glass has. Accordingly, for the plate thickness of about 3 mm, the former has as twice as high an impact strength as that of the latter.

Therefore, by the use of chemically strengthened glass it is possible to substantially reduce the thickness of the galss plate and hence reduce the total material, which in turn reduces the cost. In addition, where the structure of the illustrated embodiment is used, the depth of drawn portion of the frame 28 to form for example the shoulder may be shallow. This facilitates machining and also reduces the warp after the machining. Therefore, the simplicity of the frame can be enhanced, which in turn reduces the leakage electromagnetic wave.

2. Because of its manufacturing process, the thermally strengthened glass has a deep strengthened layer and the internal stress is not uniformly distributed to exhibit an overall balance therebetween. Accordingly, if a portion of the glass is cracked, the balance of stress is destroyed and the entire glass is shattered. This character may be advantageous in a certain application such as with automobile glass, but in the case of the microwave oven it is rather disadvantageous because there is a risk of self-explosion by a small crack.

On the contrary, the chemically strengthened glass has a thin strengthened layer which is uniform. Therefore, even if it is cracked locally the entire glass is not broken and hence there is no risk of self-explosion by a small crack.

When an article having a sharp end such as a metal skewer is disposed in the microwave oven in proximity to the door screen, arc discharge occurs between the door screen and the metal skewer. If the thermally strengthened glass were used in the structure of the illustrated embodiment, it would be broken even by arc discharge of a very short period. When the chemically strengthened glass is used no such inconvenience occurs because of its characteristic as stated above and hence a highly reliable door screen can be provided.

3. The thermally strengthened glass produces warp during strengthened process while the chemically strengthened glass does not produce warp because contracted layer is produced uniformly. As a result no undue stress is applied to the strengthened glass when it is clamped, and the simplicity of one plane of the oven is enhanced and hence the distribution of heating energy is improved.

4. The surface hardness of the glass increases by a chemical strengthening process. Accordingly, the door screen is unlikely to crack during the usage of the oven and the clarity of the door screen can be maintained for an extended period.

What is claimed is:

1. A microwave oven comprising a main body having a heating cavity therein, a door mounted to said main body for closing a front opening of said heating cavity, a microwave generator for radiating microwave energy into said heating cavity, and a door screen mounted on said door, said door screen including a punched metal plate interposed between transparent plates, said punched metal plate having a thickness of 0.10 to 0.35 mm, an aperture diameter of not larger than 1.2 mm and a ratio of the aperture diameter to a center-to-center distance of the apertures of 0.67 to 0.85, an extended portion of said punched metal plate being coupled to a metal plate which electrically couples the heating cavity body to the door body.

2. A microwave oven according to claim 1 wherein said punched metal plate is made of an aluminum material having an oxidized coating of less than 15 microns thereon.

3. A microwave oven according to claim 1 wherein the transparent plate closer to the heating cavity is made of chemically strengthened glass.

* * * * *